United States Patent [19]

Kosmas

[11] Patent Number: 4,681,050

[45] Date of Patent: Jul. 21, 1987

[54] BOBBIN IN RUN-OUT DETECTOR, AND A BOBBIN CHANGING MECHANISM INCORPORATING THE DETECTOR

[76] Inventor: Nikolaos Kosmas, 14 Anne Street, McKinnon, Victoria, Australia

[21] Appl. No.: 672,258

[22] PCT Filed: Feb. 22, 1984

[86] PCT No.: PCT/AU84/00023

§ 371 Date: Oct. 23, 1984

§ 102(e) Date: Oct. 23, 1984

[87] PCT Pub. No.: WO84/03310

PCT Pub. Date: Aug. 30, 1984

[30] Foreign Application Priority Data

Feb. 23, 1983 [AU] Australia ..... PF 8163/83

[51] Int. Cl.[4] ..... D05B 45/00; D05B 59/04

[52] U.S. Cl. ..... 112/278; 112/186; 112/180; 112/273

[58] Field of Search ..... 112/273, 278, 180, 186; 139/273 R; 242/37 R; 250/561, 562, 572; 28/187

[56] References Cited

U.S. PATENT DOCUMENTS

| | | | |
|---|---|---|---|
| 2,350,397 | 6/1944 | Haas | 112/219 |
| 2,438,459 | 3/1948 | Sebell | 112/186 |
| 2,526,279 | 10/1950 | Roseman | 112/218 |
| 2,651,275 | 9/1953 | Moore | 112/219 |
| 2,733,676 | 2/1956 | Schumann et al. | 112/180 |
| 2,760,024 | 8/1956 | Tunstall | 200/61.15 |
| 3,332,381 | 7/1967 | Dobner et al. | 112/186 |
| 3,509,840 | 5/1970 | Rovin | 112/181 |
| 3,599,586 | 8/1971 | Newman | 112/218 |
| 3,601,073 | 8/1971 | Simpson | 112/218 |
| 3,744,442 | 7/1973 | Michaels et al. | 112/186 |
| 3,747,547 | 7/1973 | Mayer et al. | 112/186 |
| 3,845,320 | 10/1974 | Winberg | 250/571 |
| 3,981,256 | 9/1976 | Sexton | 112/180 |
| 4,029,266 | 6/1977 | Mori et al. | 242/20 |
| 4,161,153 | 7/1979 | Nawa et al. | 112/279 |
| 4,163,158 | 7/1979 | Coughenour et al. | 250/561 |
| 4,180,007 | 12/1979 | Peterson et al. | 112/278 |
| 4,188,902 | 2/1980 | Kahan | 112/278 |
| 4,214,542 | 7/1980 | Odermann | 112/278 |
| 4,216,733 | 8/1980 | Kornatowski | 112/184 |
| 4,223,618 | 9/1980 | Cislak | 112/180 X |
| 4,250,825 | 2/1981 | Kamiyama | 112/278 |
| 4,333,411 | 6/1982 | Lerner | 112/278 |
| 4,522,139 | 6/1985 | Beverly | 112/278 X |

FOREIGN PATENT DOCUMENTS 2263327 3/1974 France .

*Primary Examiner*—Peter Nerbun

*Attorney, Agent, or Firm*—Arnold, White & Durkee

[57] ABSTRACT

A bobbin run-out detector for a lockstitch sewing machine is responsive to thread tension for sensing when the bobbin is empty of thread. The thread tension is sensed by a hook member (168; 332) engageable with the thread extending from the bobbin, the hook member (168; 332) being moved by a resilient bias as a result of loss of thread tension consequent on emptying of the bobbin. The hook member (168; 332) is linked to a shutter (174; 334) which moves with the hook member (168; 332) in order to influence a light beam, light receiving means (202) being responsive to such influence to produce a signal indicative of bobbin run-out. The signal may stop the machine and/or actuate an alarm. Alternatively, the signal may actuate a bobbin change device (2, 4, 14, 16) for removing the empty bobbin and for inserting a previously wound bobbin, to permit sewing to resume.

20 Claims, 27 Drawing Figures

BOBBIN IN RUN-OUT DETECTOR, AND A BOBBIN CHANGING MECHANISM INCORPORATING THE DETECTOR

The present invention relates to a bobbin run-out detector for a lockstitch sewing machine and to an automatic bobbin changing mechanism incorporating the run-out detector.

It is known to provide lockstitch sewing machines, particularly industrial sewing machines, with a bobbin run-out detector in order to detect when the bobbin thread is substantially depleted. Upon detection of this condition, a signal may be given to the operator to stop sewing and to change the bobbin. Alternatively, the signal may be used to initiate operation of a bobbin rewinding mechanism. One previously proposed run-out detector intended for use with machines having manual bobbin change comprises a sensor in the form of a light beam which is responsive to decreasing bobbin diameter. A run-out detector of this type is disclosed for example in U.S. Pat. Nos. 4,212,257; 4,178,866; and 4,163,158. This previously proposed sensor does not have a high degree of sensitivity and cannot be used for accurately determining when the bobbin thread is at the point of depletion. The result of this is that this previously proposed sensor may trigger when there is still a substantial length of thread remaining on the bobbin.

This residual thread tends to cause difficulties during subsequent operation of the bobbin after rewinding, and therefore with manual bobbin change systems the residual thread is usually manually removed before the bobbin is rewound. Apart from the inherent wastage of thread, this leads to a reduction in efficiency. If this run-out detector were to be incorporated in a mechanism for automatically rewinding the bobbin, it would not usually be possible to remove any residual thread from the bobbin with the result that subsequent operation of the machine may be impaired.

A requirement accordingly exists for a run-out detector for accurately determining when the bobbin is empty, both for use in machines with manual bobbin change and for use in machines having provision for automatic bobbin change and/or rewinding.

There has been proposed a mechanism for rewinding the bobbin of a lockstitch sewing machine while the bobbin is in situ in the hook of the sewing machine. This means that the sewing machine cannot be operated during rewinding of the bobbin, and as mechanisms of this nature are primarily intended for use on industrial sewing machines, the benefits resulting from automatic rewinding are offset by the down-time of the machine. U.S. Pat. No. 4,216,733 describes such a mechanism.

A requirement accordingly exists for mechanism which can automatically change and rewind a bobbin without causing significant down time of the sewing machine. It is also necessary that the mechanism includes a run-out detector for accurately determining when the bobbin is empty so that the change and winding cycle is initiated only when the bobbin is empty in order to avoid difficulties arising from the presence of residual thread on the bobbin to be rewound. Finally, it is necessary that the run-out detector is such that it can operate effectively within the very confined space in the zone of the hook.

According to the invention, there is provided a run-out detector for sensing when the bobbin of a lockstitch sewing machine is empty, said detector comprising means engageable with the thread extending from the bobbin such that the thread-engaging means is responsive to bobbin thread tension and moves as a result of loss in thread tension, means for transmitting an energy beam, means for receiving an energy beam, and means responsive to the thread-engaging means and movable relative to the path of said energy beam upon movement of the thread-engaging means consequent on loss of thread tension, whereby to influence said beam, said beam receiving means being responsive to such influence of the beam to provide a signal indicative of a run-out condition.

Further according to the invention, there is provided a mechanism for automatically changing and winding the bobbin of a lockstitch sewing machine, said mechanism comprising means responsive to bobbin thread tension for sensing when a bobbin in an operative position in the hook of the machine is empty, means responsive to the sensing means for withdrawing the empty bobbin from the hook and for subsequently inserting a previously-wound bobbin into the hook to enable the machine to resume sewing, and means for rewinding the empty bobbin during operation of the sewing machine, the latter bobbin, when rewound, being in a condition to be inserted into the hook in a subsequent bobbin-change cycle.

Still further according to the present invention, there is provided a mechanism for changing an empty bobbin of a lockstitch sewing machine, said mechanism comprising a bobbin change device for removing an empty bobbin from the hook of the machine and for inserting a previously-wound bobbin into the hook, and a run-out detector for sensing when the operative bobbin within the hook of the machine is empty of thread, said detector comprising means engagable with the thread extending from the bobbin so that the thread-engaging means is responsive to bobbin thread tension and moves as a result of loss in thread tension, means for transmitting an energy beam, means for receiving the energy beam, and means linked to the thread-engaging means and movable relative to the path of said energy beam upon movement of the thread-responsive means consequent on loss of thread tension, whereby to alter the path of said beam, said beam receiving means being responsive to such alteration of the path to initiate operation of the bobbin change device.

Preferably, the energy beam is transmitted through a hollow core of the bobbin onto a reflective surface on the hook to be reflected back through the bobbin core to the receiving means, and the means for altering the path of the beam comprises a shutter moveable to expose or block the reflective surface.

The thread-engaging means and the shutter are preferably mounted on a stationary base mounted within the hook, the bobbin being removably mounted on the base.

Preferably, the energy beam is a light beam.

An embodiment of the invention will now be described, by way of example only, with reference to the accompanying drawings in which.

Figure 2:
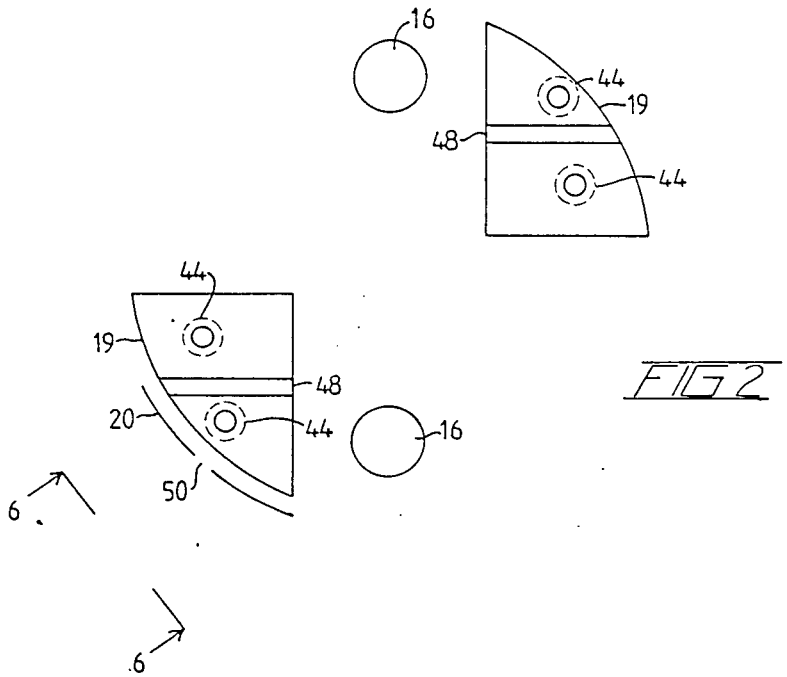
FIG. 2 is a view looking in the direction of line 2—2 of FIG. 1 to show, schematically, thread holders of the turret and a thread guide plate of the carriage.
Figure 7A:
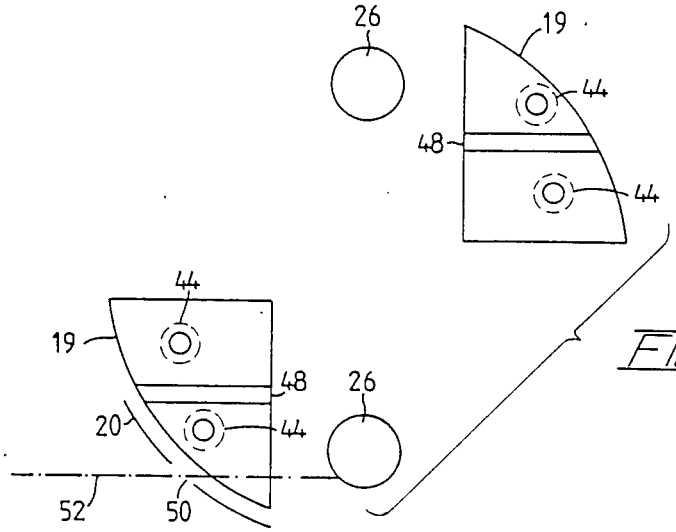
Figure 7B:
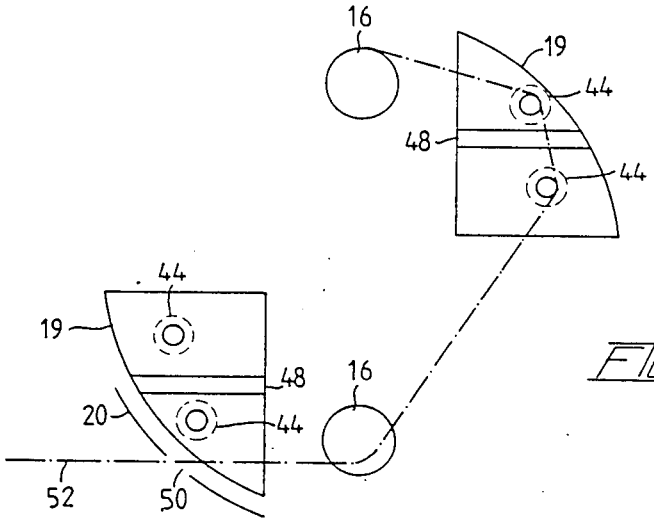
Figure 8A:
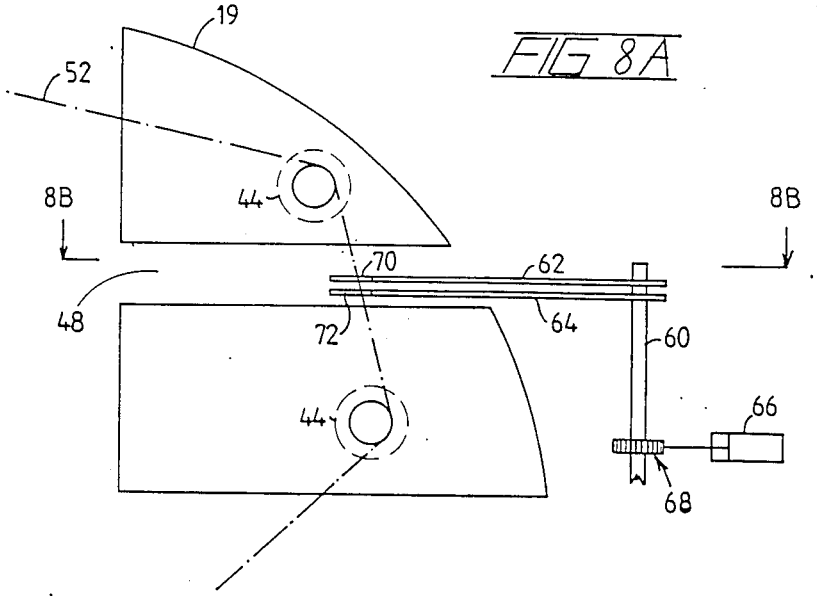
Figure 8B:
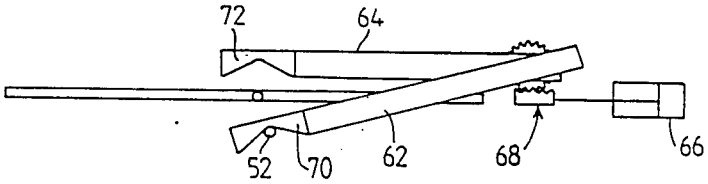
Figure 9:
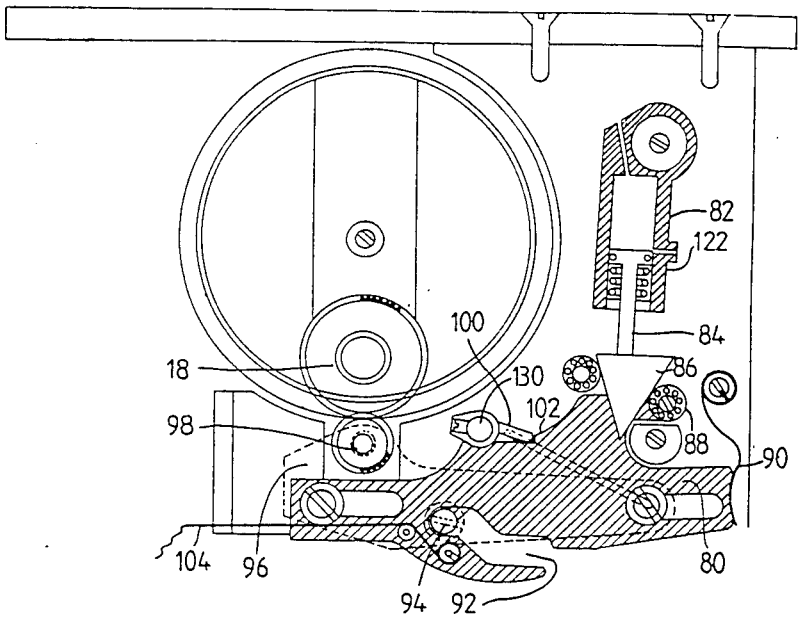
Figure 10:
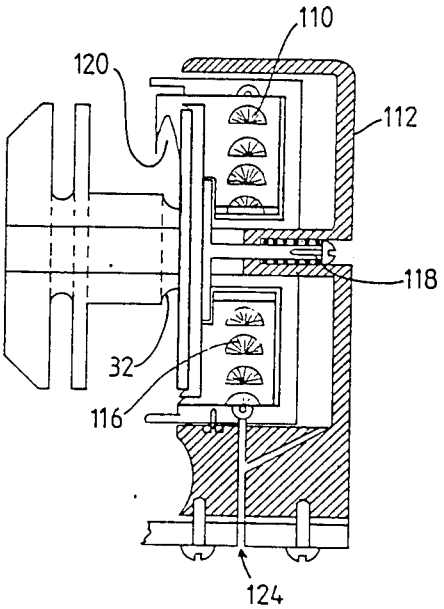
Figure 11:
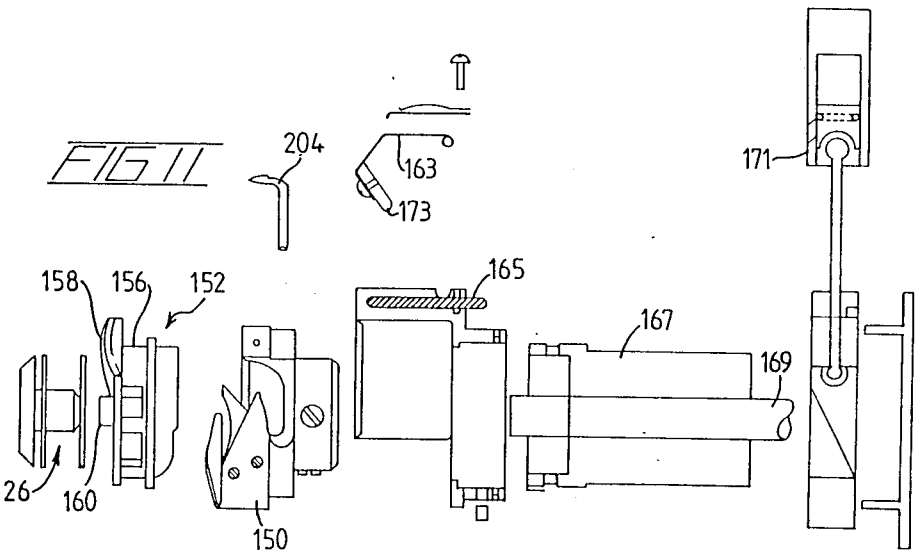
Figure 15:
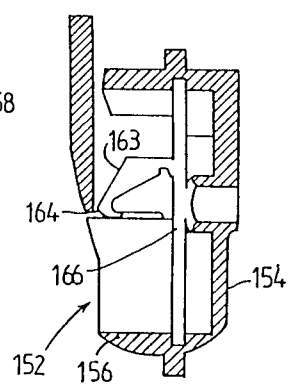
Figure 14:
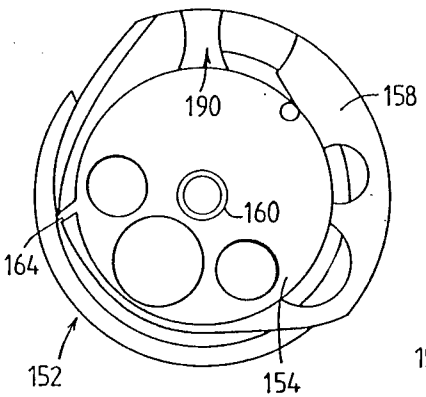
Figure 13:
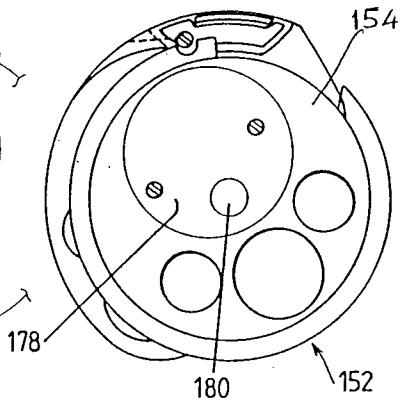
Figure 12:
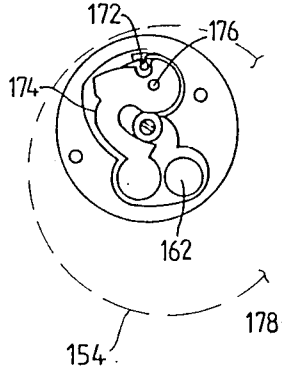
Figure 16:
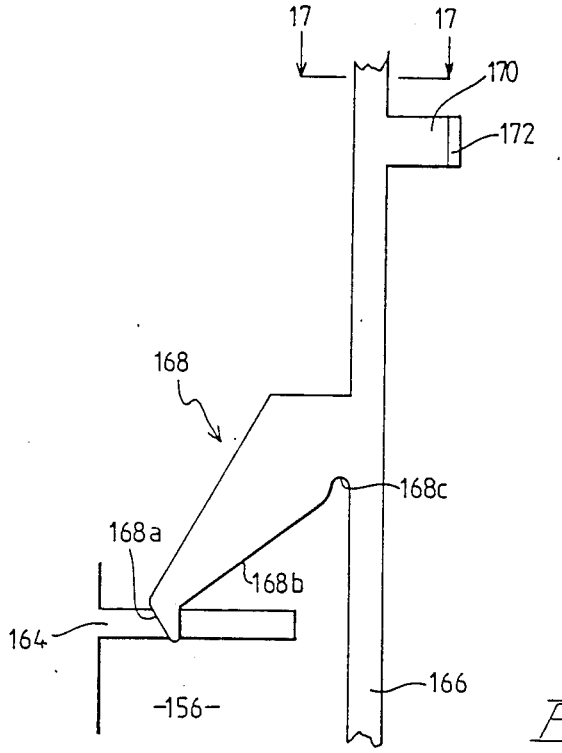
Figure 17:
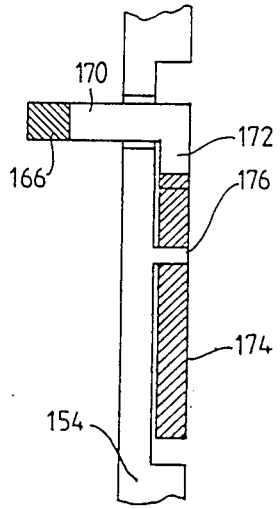
Figure 18:
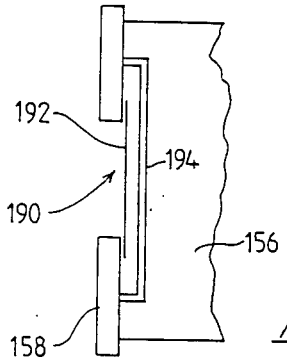
Figure 19:
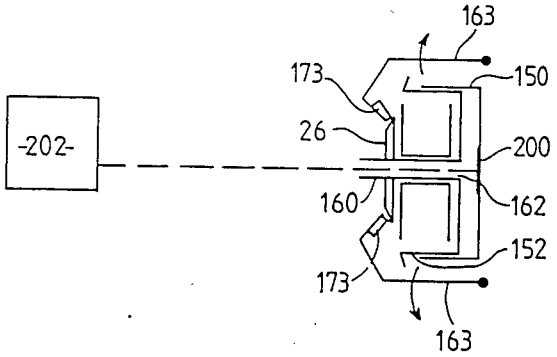
Figure 20:
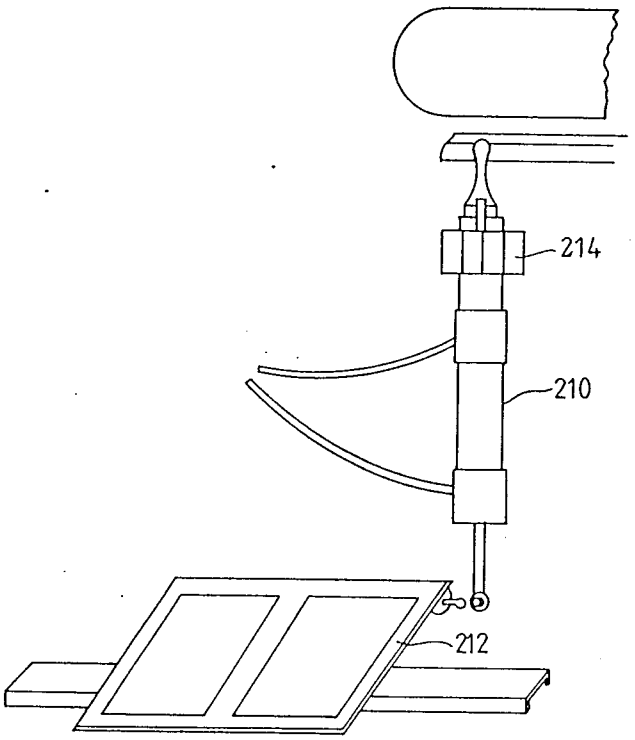
Figure 21:
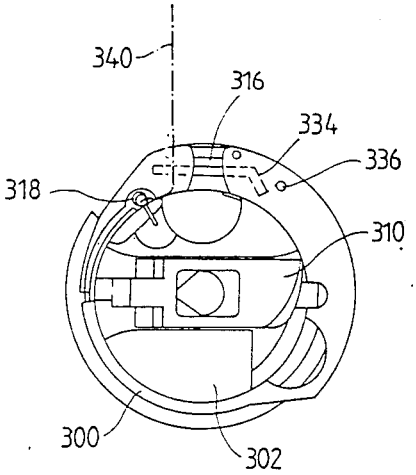
Figure 22:
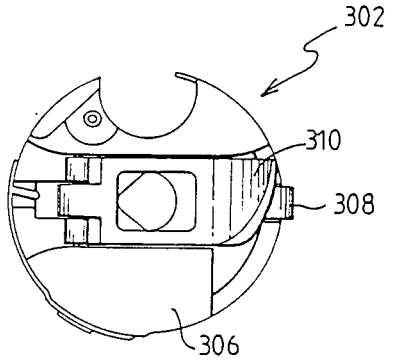
Figure 23:
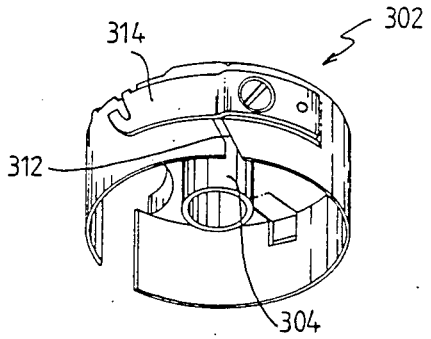
Figure 24:
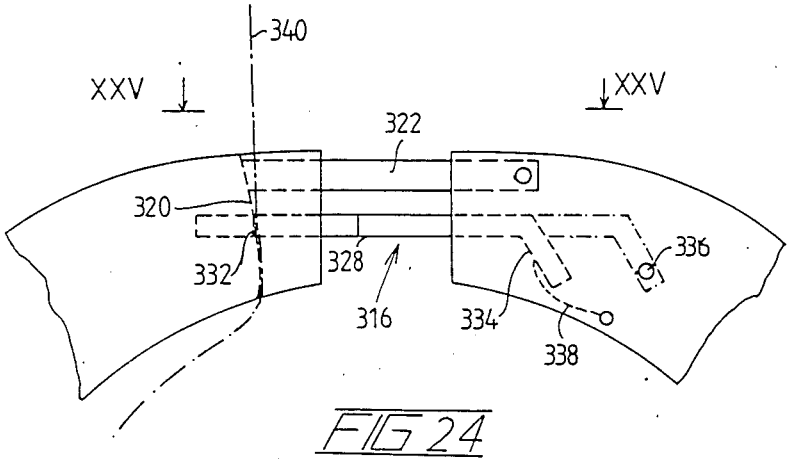
Figure 25:
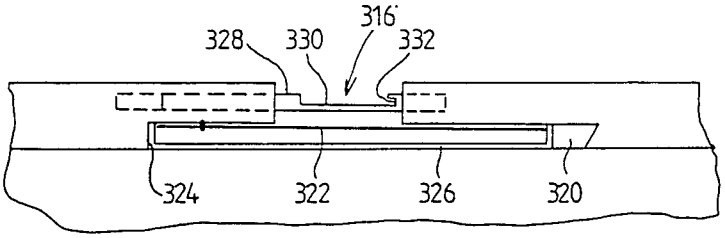

FIG. 7*a* is a view similar to FIG. 2, but showing the thread path with a fully-wound bobbin at a winding position;

FIG. 7*b* is a view similar to FIG. 7*a*, but showing the thread path after the turret has been indexed to move the fully-wound bobbin into a position at which it can be inserted into the hook of the sewing machine and to move the empty bobbin, which has been previously withdrawn from the hook, into the winding position;

FIG. 8*a* is an enlarged detail of FIG. 7*b* to show a thread draw-off and cutter device;

FIG. 8*b* is a view in the direction of line 8*b*—8*b*of FIG. 8*a*;

FIG. 9 is a view showing, in greater detail, the bobbin winding device;

FIG. 10 is a view showing a thread pick-up and winding turbine of the winding device;

FIG. 11 is an exploded view showing the hook of the sewing machine, a bobbin, and a stationary base for mounting the bobbin within the hook;

FIG. 12 is a view showing a shutter incorporated in a recess within the base, the shutter forming part of a bobbin thread run-out detector;

FIG. 13 is a rear view of the base and showing a cover which retains the shutter in the recess;

FIG. 14 is a front view of the base;

FIG. 15 is a cut away view of the base;

FIG. 16 is a developed view showing, purely schematically, a thread tension sensor hook mounted in the base;

FIG. 17 is a view looking in the direction of line 17—17 of FIG. 16;

FIG. 18 is a view of a thread tensioner in the base;

FIG. 19 is a view showing, purely schematically, a bobbin installed within the base and the hook;

FIG. 20 is a view showing a foot pedal and associated components of the sewing machine;

FIG. 21 shows a stationary base receiving a bobbin case, the base being within the hook of a lockstitch sewing machine with manual bobbin change;

FIGS. 22 and 23 are enlarged views of the bobbin case;

FIG. 24 is a fragmentary enlarged view showing details of a run-out detector incorporated in the base; and FIG. 25 is a fragmentary enlarged view in the direction of arrows XXV—XXV of FIG. 24.

GENERAL DESCRIPTION - FIGS. 1 TO 20

A general description of the construction and operation of the bobbin changer and winder mechanism will first be given. A detailed description of the various components of the mechanism will then follow. The mechanism is incorporated in a conventional lockstitch industrial sewing machine having conventional components such as an oscillating feed dog shaft and a hook driven by a hook shaft with a bobbin being carried within the hook.

The mechanism comprises a carriage which supports a rotatable turret comprising a pair of bobbin holders. The bobbin holders are located on opposite sides of the rotational axis of the turret which is parallel with the axis of the hook shaft of the sewing machine. The turret can be indexed through steps of 180° to place each of the bobbin holders, in turn, in axial alignment with the hook on the hook shaft, and thus with the bobbin carried in the hook. The carriage is reciprocably driven by means of a pneumatic cylinder for movement along an axis parallel to that of the hook shaft between a rear position in which the bobbin holders are remote from the hook, and a forward position in which that bobbin holder which is aligned with the hook is in a position adjacent the hook to either pick up an empty bobbin in the hook or to deposit a full bobbin in the hook. The other bobbin holder is in axial alignment with a thread winding device.

The state of the bobbin in the hook is sensed by a run-out detector which is responsive to bobbin thread tension. The thread tension will drop just as the thread empties from the bobbin, and this loss in tension is used to trigger operation of the changer and winder mechanism. At this stage, the carriage is in its rear position, one of the bobbin holders on the turret is aligned with the hook to subsequently pick up the empty bobbin and the second bobbin holder carries a fully wound bobbin. Upon receipt of the signal indicating loss of bobbin thread tension, the machine is automatically stopped, and the carriage is advanced to its forward position to present the first bobbin holder to the empty bobbin. The carriage is then retracted so that the first bobbin holder withdraws the empty bobbin. When the carriage is in its rear position, the turret is indexed through 180° to present the second bobbin holder, with the wound bobbin, in alignment with the empty hook. The carriage is then advanced again, so that the wound bobbin is presented to the hook. When the wound bobbin is in position, the second bobbin holder releases the bobbin and the carriage is retracted. Sewing can then recommence. The empty bobbin is rewound on the second bobbin holder when the carriage has returned to its retracted position, and the mechanism is thus in a condition to start the next change cycle when the operative bobbin empties.

At the start of the change cycle, upon receipt of the signal from the tension sensor device, a pneumatic cylinder interposed in the linkage between the conventional control pedal of the machine and a substantially conventional control switch, is actuated to lock the control pedal against operation during bobbin change. The cylinder also actuates the control switch to initiate operation of a synchronising drive which sets the hook shaft and thus the hook in a predetermined angular position to receive the wound bobbin. The cylinder is automatically set into a condition after bobbin change in which the foot pedal is released to permit the operator to recommence sewing.

The complete change cycle takes between 3 and 4 seconds.

With the changer and winder mechanism described, a short length (typically 2cm) of bobbin thread may extend from the fabric when the bobbin has emptied. This can be removed by incorporating a conventional underbed thread trimmer. Without the thread trimmer, it may sometimes be advisable to remove the workpiece during bobbin change in order to withdraw the short length of residual thread.

Carriage, Turret and Bobbin Holders and Bobbin

Figure 1:
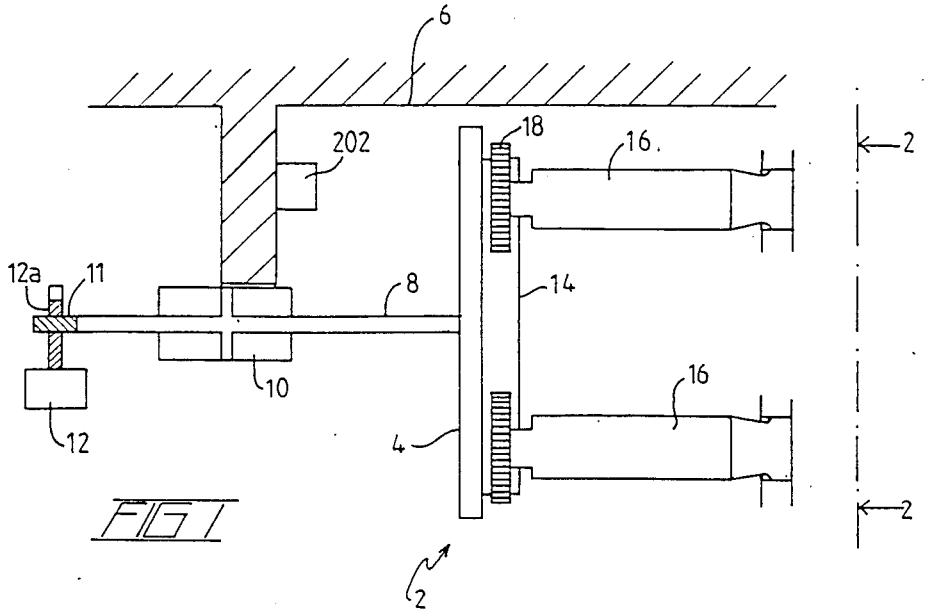
FIG. 1 shows, schematically, a carriage and turret of a bobbin changing and winding mechanism in accordance with a preferred embodiment of the invention.

As shown schematically in FIGS. 1 and 2, the carriage 2 comprises a disc-like base part 4 mounted for reciprocating movement relative to a fixed part 6 of the frame of the sewing machine, along an axis extending parallel to the axis of the hook shaft and feed dog shaft of the sewing machine. The base part 4 is carried by the piston rod 8 of a pneumatic cylinder 10, the axis of which is parallel to that of the hook shaft and feed dog shaft. The body of the cylinder 10 is fixedly mounted from the frame part 6, and actuation of the cylinder 10 causes reciprocation of the base part 4 between its rear and forward positions. The piston rod 8 of the cylinder 10 is rotatable relative to the cylinder body and is extended rearwardly beyond the cylinder body. A gear 11 at the rear end of the piston rod 8 engages a worm shaft 12*a* of a fixed indexing motor 12 when the piston rod 8, and thus the carriage 2, is in its rear position. The motor 12 is actuable to index the piston rod 8 through discrete steps of 180° in the same direction.

The base part 4 carries a turret 14 in the form of a plate which is fast for rotation with the base part 4 and the piston rod 8. The turret 14 rotatably supports a pair of bobbin holders 16 located on opposite sides of the axis of the piston rod 8. Each bobbin holder has, at its base end, a gear wheel 18. The gear wheel 18 of that bobbin holder 16 which is in the winding position is engaged by a drive gear of a winding device whereby to rotate the bobbin holder; this will be described in greater detail later.

The turret 14 also carries a pair of thread holders 19 (see FIG. 2) which hold the thread by friction. One thread holder 19 is associated with each respective bobbin holder 16, the thread holder 19 being located in a position adjacent to the bobbin-holding end of the bobbin holder. The base part 4 supports a thread guide plate 20 which is angularly movable through a limited extent about the axis of the piston rod 8. The thread guide plate 20 is adjacent that one of the thread holders associated with the bobbin holder at the bobbin winding position (that is, the bottom bobbin holder as viewed in FIG. 2).

A bobbin winding device which will be described later is positioned to co-operate with the bobbin of the bobbin holder at the winding position.

Figure 3:
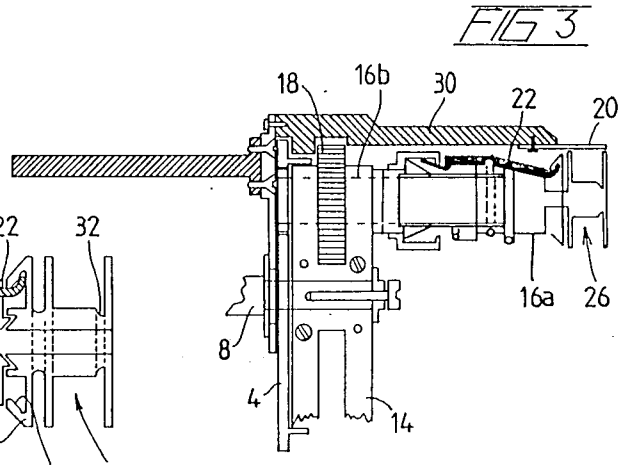
FIG. 3 is a fragmentary section showing the turret in somewhat greater detail.
Figure 4:
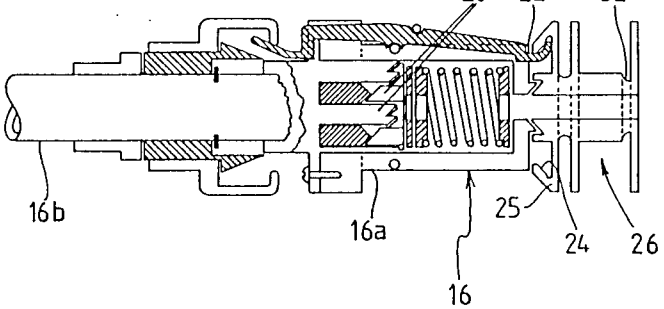
FIG. 4 is a fragmentary section showing a bobbin holder of the turret.

With reference to the more detailed illustrations of FIGS. 3 and 4, each bobbin holder 16 comprises a body 16*a* which carries, at its free end, an array of radially expandable and contractable hooked fingers 22, typically three such fingers uniformly distributed around the axis of the bobbin holder. When in their contracted condition, the fingers 22 can enter or withdraw from an undercut annular recess 24 formed in an additional flange 25 incorporated at the end of a bobbin 26, and when expanded the fingers 22 will engage the wall of the recess 24 to retain the bobbin 26 on the bobbin holder 16. The bobbin holder also comprises an internal spring-loaded ratchet mechanism generally indicated at 28 which is responsive to axial movement between the bobbin holder body 16*a* and a bobbin holder shaft 16*b* to move the fingers 22 from their expanded to their contracted conditions and vice versa. The ratchet mechanism 28 retains the fingers 22 in one such condition until subsequent actuation of the ratchet mechanism consequent upon axial movement between the holder body 16*a* and holder shaft 16*b* to set and retain the fingers into the other condition. Such relative axial movement and actuation of the ratchet mechanism 28 occurs when the bobbin holder which is aligned with the hook is advanced axially by the carriage into engagement with an empty bobbin in the hook, or when the bobbin holder with a fully wound bobbin thereon is being seated within the hook. The precise construction of the ratchet mechanism is not critical to the present invention and full description will not be given. Instead of using a ratchet mechanism, the fingers can be expanded and contracted by pneumatic means or electromagnetic means.

The bobbin holder shaft 16*b* is coupled to the gear wheel 18 which is shown in FIG. 3. This Figure also shows the turret 14, the piston rod 8, and the thread guide plate 20, the latter being carried by an arm 30 which is supported on the periphery of the disc-like base part 4. The mounting of the arm 30 relative to the base part 4 is such that the arm 30 (and thus the plate 20) moves with the base part 4 during the reciprocating motion of the base part 4, but it does not follow the indexing rotation of the base part 4, the base part 4 being rotatable relative to the arm 30 for pivotal movement about the axis of the piston rod 8. Pivotal movement of the guide plate 20 is effected by means of a pneumatic cylinder (not shown) acting between the piston rod 8 and an extension of the arm 30.

Finally, it will be noted from FIG. 4 that the core of the bobbin 26 is provided with an annular groove 32. This annular groove is used to position the thread at the start of rewinding as will be decsribed later.

Thread holders and Thread Guide Plate

Figure 6:
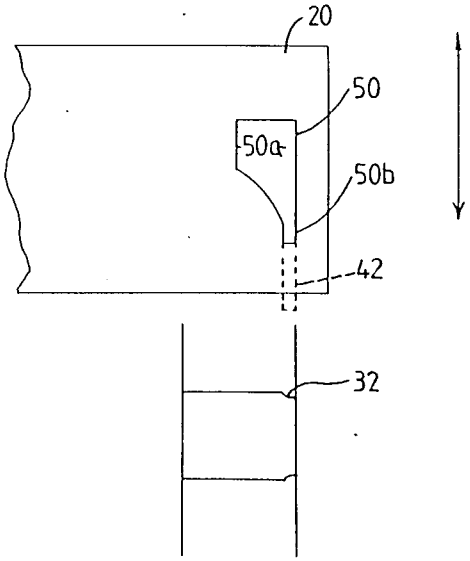
FIG. 6 is a view in the direction of line 6—6 of FIG. 2 and showing the thread guide plate in greater detail.
Figure 5:
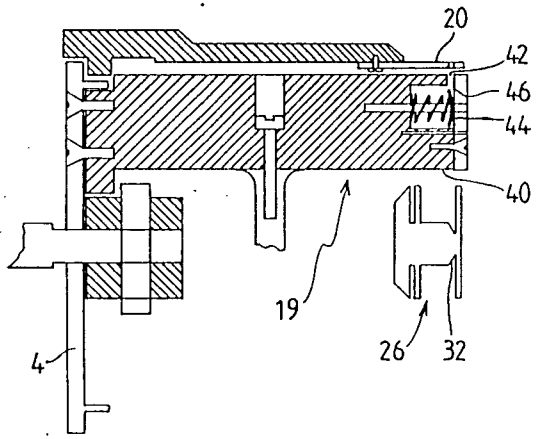
FIG. 5 is a fragmentary section showing a thread holder in greater detail.

With reference to FIGS. 2, 5 and 6, each thread holder 19 comprises a block-like structure 40 which is cantilevered from the base part 4. The free end of the structure 40 is formed with a slot 42 which is in a position aligned with the groove 32 of the bobbin 26 on the associated bobbin holder 16. Within the slot 42 are a pair of spring-biased thread holding buttons 44 which act to frictionally retain the thread against a side wall 46 of the slot 42.

The two buttons 44 of each thread holder 19 are spaced along the thread path and are separated by an axial slot 48 (see FIG. 2) formed in the structure 40.

The slot 48 serves to receive a thread draw-off and cutter device when the newly-wound bobbin has been placed in the hook. The draw-off and cutter device will be described later.

The thread guide plate 20 is formed with a thread guide slot 50 which is shaped as shown in FIG. 6. It will be seen that the slot 50 has an enlarged mouth section denoted by 50*a*, leading to a throat section 50*b* which is in alignment with the slot 42 (shown in broken lines) in the thread holder and with the groove 32 of the bobbin on the bobbin holder. The direction of pivotal movement of the plate 20 is indicated by the arrow in FIG. 6.

The manner in which the thread holders and guide plate operate will now be illustrated with reference to FIGS. 7*a* and 7*b*. In both these Figures, the lower bobbin position is the bobbin-winding position, and the upper bobbin position is aligned with the hook.

In FIG. 7*a*, the bobbin 26 in the lower position is a fully wound bobbin and the bobbin in the upper position is an empty bobbin which has just been withdrawn from the hook. The wound bobbin was wound with thread from a thread source, and at this point in the cycle the bobbin thread is still attached to the thread source. The thread is shown in chain lines at 52 in FIG. 7*a*; it will be noted that the thread passes to the bobbin via the slot 50 in the guide plate 20 and the slot 42 in the thread holder 19, but the thread is not inserted sufficiently deeply within the slot 42 to be retained by the buttons 44.

FIG. 7*b* shows the thread path after the turret 14 has been indexed anti-clockwise through 180° from the FIG. 7*a* position, in order to place the wound bobbin in alignment with the hook, and the empty bobbin at the winding position. This 180° rotation of the turret 14 causes the thread attached to the wound bobbin to be drawn more deeply into the slot 42 of its associated thread holder 19, whereby the thread is frictionally retained by the buttons 44. During the rotation of the turret 14, the thread guide plate 20, which does not rotate with the turret, is moved clockwise through about 45° (upwards as viewed in FIG. 6). This movement causes the thread to be guided from the enlarged mouth section 50*a* of the slot 50 into the throat section 50*b*. The thread is thus positioned to enter the groove 32 of the empty bobbin and the inlet portion of the slot 42 of the associated thread holder, as these move into the winding position. The plate 20 is subsequently returned to its original position.

Thread Draw-off and Cutter Device

With the turret and thread positioned as indicated in FIG. 7*b*, the carriage 2 is advanced to place the wound bobbin in the hook. The placement of the bobbin in the hook will be described in detail later. When the wound bobbin is in position in the hook the carriage 2 is retracted, and shortly before the carriage 2 reaches the end of its return stroke, the thread draw-off and cutter device is actuated to cut the thread between the two buttons 44 on the thread holder 19 associated with the wound bobbin.

As shown schematically in FIGS. 8*a* and 8*b*, the thread draw-off and cutter device comprises an actuating shaft 60 which carries a thread draw-off arm 62 and a thread cutter arm 64. The shaft 60 is driven from a pneumatic cylinder 66 via a rack and pinion linkage 68 to pivot the arms 62 and 64 into the slot 48 of the thread holder 19 associated with the wound bobbin. The draw-off arm 62 is rigidly connected with the shaft 60, and the cutter arm 64 is connected with the draw-off arm 62 by a spring-loaded lost-motion linkage (not shown). This linkage delays movement of the cutter arm 64 relative to the draw-off arm 62 and permits a draw-off part 70 of the draw-off arm to engage the portion of the thread 52 between the spring-loaded retaining buttons 44 and to cause a short length to be withdrawn from the wound bobbin (this is necessary to provide a sufficient thread length for commencement of sewing). The lost-motion linkage then releases and the cutter arm 64 is spring biased to move into the same angular position as the draw-off arm 62; in so doing a cutter part 72 of the cutter arm 64 engages the thread 52 and thereby cuts the thread. The detailed construction of the lost-motion linkage is not critical to the present invention and further details will not be given here. Suitable forms of lost-motion linkage will be readily apparent to those skilled in the art.

After cutting, the shaft 60 is moved to withdraw the arms 62 and 64 from the slot 48 of the thread holder 19. As will be apparent, at this stage in the cycle, the cut end of the wound bobbin thread will be frictionally held by the uppermost retaining button 44 as viewed in FIG. 8*a*, and the cut end of the thread extending from the thread source via the empty bobbin will be frictionally held by the lowermost retaining button 44 as viewed in FIG. 8*a*.

Bobbin Winding Device

As mentioned earlier, the bobbin winding device is in a position to start winding the empty bobbin and this occurs substantially simultaneously with recommencement of stitching using the previously wound bobbin.

With initial reference to FIG. 9, the bobbin winding device comprises a plate 80 mounted for reciprocatory movement in a horizontal direction as viewed in FIG. 9. The plate 80 is movable to the right (in FIG. 9) by means of a single-acting pneumatic cylinder 82, the piston rod 84 of which carries a cam block 86 engagable with a follower roller 88 on the plate 80. Such movement is against the bias of a torsion spring 90. The plate 80 is formed with a cam slot 92 in which is engaged a follower 94 carried by a pivoted plate 96 (shown in dotted lines in FIG. 9) which carries a winding driving gear 98 which is driven by an electric motor (not shown). Upon actuation of the cylinder 82, the plate 80 is moved to the right (as viewed in FIG. 9) against the bias of the spring 90. Due to the interaction between the cam slot 92 and the follower 94, the plate 96 is pivoted upwards (in FIG. 9) to place the driving gear 98 into engagement with the gear wheel 18 of the bobbin holder 16 in the winding position. The plate 80 is retained in its right-hand position, in which the gear 98 is in engagement with the gear wheel 18 by a spring-biased latch 100 which pivots into engagement behind a stop shoulder 102 on the plate 80 when the plate is in its right-hand position.

The plate 80 is linked by means of a cable 104 to a microswitch which controls operation of the winding motor which drives the gear 98, so that the gear 98 is driven when the plate 80 is in its right hand position.

The bobbin winding device also incorporates means for picking-up the cut end of the thread from the lowermost retaining button 44 of FIG. 8*a* and winding this around the bobbin groove 32 to prevent thread slippage. The pick-up means is shown in FIG. 10 and comprises a pneumatically-driven annular turbine wheel 110 mounted in a chamber 112 carried by the base part 4 in such a position that the turbine wheel 110 will be axially aligned with an empty bobbin at the winding position. The pick up means is located in a fixed angular position (in other words, it does not follow the indexing rotation of the base part 4) but is reciprocated with the base part 4. The turbine wheel 110 is formed with pockets 116 around its outer periphery onto which an air jet impinges to cause rotation of the wheel 110. In addition to its rotational movement, the turbine wheel 110 is also mounted for axial movement in a direction towards the empty bobbin. Such axial movement is provided by injecting air into the chamber 112 behind the rear face of the turbine wheel so that the wheel is pushed to the left as viewed in FIG. 10. This injection of air occurs simultaneously with the peripheral injection of air, and occurs against the action of a biasing spring 118 which returns the wheel 110 to the right when air injection ceases.

The front face of the wheel 110 (that is, the left hand face as viewed in FIG. 10) is provided with a recess which can receive the flange of the bobbin when the wheel is pushed to the left, and a peripheral rim around the recess. The rim is shaped to form a thread-engaging hook 120 which is aligned with the bobbin groove 32 and thus also with the thread passing via the bobbin groove to the lower friction retaining button 44 of FIG. 8*a*.

The pneumatic cylinder 82 (FIG. 9) used to drive the plate 80 which effects engagement of the driving gear 98 with the gear wheel 18 of the bobbin holder has an outlet port 122 which is connected to a chamber inlet port 124 from which air is directed onto the periphery of the wheel 110, and into the chamber behind the wheel 110. During the initial part of the movement of the piston of the cylinder 82, the outlet port 122 is blocked by the piston. Towards the end of the movement, that is, as the plate 80 is locked in position by ratchet 100, the port 122 is opened and air is fed from the cylinder 82 via port 124 to the turbine wheel whereby to advance the turbine wheel over the flange of the bobbin and to rotate the wheel so that the hook 120 engages the thread, pulls the cut end from the retaining button 44 and wraps it around the bobbin groove 32.

Actuation of the cylinder 82 to effect the above actions will require just a short blast of air (say, a 1 second blast) to the cylinder. When the air blast ceases, the turbine wheel will cease operating and will be withdrawn from the bobbin by its biasing spring 118. However, the plate 80, and thus the driving gear 98, remain in their operative positions due to the locking action of the latch 100.

Referring again to FIG. 9, the latch 100 is rigidly mounted on a shaft 130 to which is linked a pivotal arm (not shown) which faces the core of the bobbin being wound. When the wound core reaches a predetermined diameter, the core will engage the arm and, as the diameter further increases, pivots the arm. This pivotal movement is transmitted via the shaft 130 to the ratchet 100, in order to lift the ratchet away from the shoulder 102 of the plate 80, and thus to permit the plate to be returned to the left (as viewed in FIG. 9) under the action of the torsion spring 90. This movement causes the winding gear 98 to be disengaged from the gear wheel 18 of the bobbin holder and also, via the cable 104, de-energisation of the winding motor. Winding of the bobbin is thus finished.

Hook and Bobbin Run-Out Detector

Conventionally, in a lockstitch sewing machine, the bobbin is mounted in the hook by means of a bobbin case and a stationary base, the bobbin being held within the case, the case being held within the base, and the base being seated in the interior of the hook. In the present machine the bobbin is rotatably mounted directly in the stationary base which is modified to include part of the run-out detector which is responsive to thread tension of the bobbin thread, as will be described shortly. The hook itself is conventional, apart from an optically-reflective surface which is formed on a bottom surface of the hook.

With reference to FIGS. 11 to 19, the hook is shown at 150, and the base 152, which is seated within the hook 150, is of cup-like form and comprises a disc-like bottom plate 154 and a peripheral wall 156 provided with a flange 158 at its outer edge to form a guide surface for the thread to prevent the hook 150 from interfering with the bobbin thread. The bobbin 26 is seated in the interior of the base 152, the core of the bobbin 26 being rotatably supported on a fixed hollow spindle 160 projecting from the bottom plate 154.

As shown in FIGS. 11 and 19, the bobbin 26 is releasably retained within the base 152 by an array of arms 163 (typically two arms 163) angularly spaced around the base 152 and pivotally mounted on a fixed structure 165 attached to a bearing 167 of the hook shaft 169. The arms are pivotal by means of a pneumatic cylinder 171 between a radially outer position in which the interior of the base is open to permit insertion or withdrawal of the bobbin by the bobbin holder 16, and a radially inner position in which the free ends of the arms 163 close over the outer periphery of the bobbin within the base 152. In the closed position, blocks 173 of nylon or other low-friction material mounted at the free ends of the arms 163 slidingly engage the peripheral surface of the bobbin. The cylinder 171 is controlled to open and close the arms 163 at appropriate points in the change cycle.

The base 150 will now be described in detail.

The bottom plate 154 of the base 152 is provided with an aperture 162 aligned with the interior of the hollow spindle 160. The peripheral wall 156 of the base 152 is provided with an axially-directed thread-receiving slot 164 which can be seen in FIGS. 14 and 15. A ring 166 is mounted on the interior of the wall 156 near the bottom plate 154 for limited angular movement around the wall 156. The ring 166 carries a hook 168, the free end of which overlies the slot 164. At its axially outer edge, the hook is inclined inwardly. The hook and slot are shown in enlarged detail in FIG. 16 in which the inwardly-inclined outer edge of the hook 168 is marked **168*a*. It will also be noted that the hook has an inclined undersurface 168*b* leading to a groove 168*c* at the junction between the undersurface 168*b* and the ring 166. The reason for this configuration will become apparent in due course. The ring 166 with the hook 168 is movable angularly relative to the base through a limited angle of about 30°–35° between the hook position shown in FIG. 16, and a position in which the hook is substantially displaced from the slot 164, the movement being in an upwards direction as viewed in FIG. 16. The limits of the movement are defined by engagement of the hook 168 with abutments (not shown) on the internal surface of the wall 156**.

The ring 166 is formed with a rearwardly-directed lug 170 which projects through an arcuate slot formed in the bottom plate 154. As shown in FIGS. 12 and 17, the lug 170 is provided with a nose 172 which pivotally engages a shutter 174 located within a recess formed in the rear surface of the bottom plate 154, the shutter 174 being pivotal about a fixed pin 176. The shutter 174 can pivot within the recess between the position shown in FIG. 12 in which the aperture 162 in the bottom plate 154 is open, and a position in which the shutter 174 blocks the aperture 162. A small helical spring (not shown) is mounted within the recess in order to apply a pivotal bias to the shutter 174 in a sense to pivot the shutter to the aperture-open position. Due to the engagement between the lug 170 of the ring 166 and the shutter 174, the pivotal bias on the shutter also acts to pivotally bias the ring 166, the bias acting in a sense to move the hook 168 of the ring into the position shown in FIG. 16. The shutter and spring are retained in the recess by means of a cover 178 (see FIG. 13) secured to the rear surface of the bottom plate 154. The cover 178 is provided with an aperture 180 aligned with the aperture 162 in the bottom plate 154.

The peripheral wall 156 of the base 152 is provided with a thread guide in a position approximately 90° offset from the slot 164. As shown in FIG. 18, the thread guide is defined by an opening 190 in the flange 158. A cantilevered leaf spring 192 extends behind the opening 190, and a thread keeper bar 194 bridges the opening behind the spring 192.

The base 152 is angularly positioned so that the slot 164 will be in alignment with the thread length extending between the upper thread-retaining button 44 and the wound bobbin when the turret 14 is in the condition shown in FIG. 7*b*. The thread is moved into the slot 164, past the hook 168 upon forward movement of the turret 14 to place the bobbin in the base; in so doing, the thread engages the inclined surface 168*a* of the hook 168 to push the hook 168 aside against the spring bias, the hook 168 closing back over the thread when the thread has cleared the end of the hook 168.

At the start of sewing after the thread has been cut, as the needle lowers and the first stitch is made, the thread held by the retaining button 44 will be pulled by the first loop of the top thread (that is, the needle thread) from the retaining button 44 and is thereby looped around the hook 168 and is pulled by the loop into the gap 190, past the spring 192 to be retained between the free end of the spring 192 and the rear surface of the flange 158 so that the thread is under tension, the keeper bar 194 preventing excess deflection of the spring 192. As the tension builds up during subsequent stitches, the thread loop is pulled along the surface 168*b* of the hook into the groove 168*c*. The tension exerted by the thread loop on the hook, pivots the hook against the bias of the shutter spring, thus moving the hook 168 to a position in which the shutter 174 is held in a position to close the aperture 162.

The bottom surface of the hook 150 is made optically-reflective in the zone facing the apertures 162/180, either by machining the bottom surface of the hook, or by attaching an optically-reflective layer to the bottom surface. FIG. 19 shows, in a schematic manner, the bobbin 26 and base 152 mounted within the hook 150, with the optically-reflective zone of the bottom of the hook being marked 200. A photoelectric transmitter/-receiver 202 is mounted in a fixed position on the frame of the sewing machine to direct a light beam through the open end of the hollow spindle 160 towards the reflective zone 200, the turret and bobbin holder being apertured to permit passage of the light beam to the open end of the spindle. When the hook 168 is subject to bobbin thread tension the aperture 162 is closed by the shutter 174 and therefore the light beam will not reach the reflective zone 200. However, when the bobbin thread tension falls upon emptying of the bobbin, the shutter will move under its spring bias to the aperture open position to permit the light beam to pass through the apertures 162/180 to the zone 200 to be reflected back through the apertures and the hollow spindle 160 to the receiver part of the transmitter/receiver 202. Upon receipt of the reflected light beam, the transmitter/receiver issues a signal to stop the machine and start the bobbin change and winding cycle.

During sewing, lint removed from the thread tends to be deposited and an excessive accumulation on the reflective zone 200 could impair operation of the device. To prevent excessive build-up of lint on the reflective zone 200 of the hook, an air blast nozzle 204 (see FIG. 11) directs a blast of air onto the zone during the progress of the change cycle in order to remove lint which may have deposited on the zone during sewing.

The bobbin thread run-out detector described above thus operates on the basis of thread tension and is able to do so effectively, despite the severe space constraints in the sewing machine in the zone of the hook 150 and without having to modify the hook to any significant extent.

The light beam emitted by the transmitter may be within the visible spectrum or outside the visible spectrum. Instead of using light, other directional beams of energy which are capable of being reflected could be used, for example sonic beams.

Although as described, the shutter is operated by thread tension to close the aperture 162, it would be possible to provide a reverse arrangement in which the shutter is held open by thread tension and the receiver part of the transmitter/receiver is responsive to absence of the reflected beam upon closure of the aperture due to loss of thread tension.

With the thread run-out detector described, several stitches will be required after the start of sewing before the bobbin thread tension will be sufficient to hold the shutter in its closed position, that is the position it will assume during normal operation of the sewing machine. To prevent the detector from initiating a fresh change and winding cycle during this initial build-up of tension, the control circuitry of the detector incorporates an inhibit switch which will inhibit generation of the signal to start a fresh change cycle until a predetermined, and preferably adjustable, number of stitches has been made, usually about six stitches; by this time, the thread tension will be sufficient to hold the shutter in its normal operating position.

In one preferred form, the inhibit switch is responsive to a mechanical stitch counter driven from the feed dog shaft and brought into an active condition during bobbin change either by an electrical or pneumatic signal. The stitch counter may alternatively be an electronic counter responsive to a pick-up on the feed dog shaft or the hook shaft. The number of stitches over which the inhibit switch is operative is preferably adjustable.

Foot Pedal Linkage

Industrial needle positioning sewing machines conventionally incorporate what is termed a synchronising drive. This is operated from the foot pedal to place the needle in a raised position. The operator back pedals to operate a switch which activates the synchronising drive to cause the motor to drive the needle drive shaft to a predetermined angular position in which the needle is raised.

In the present machine, the linkage between the foot pedal and the motor control is constituted by a double-acting pneumatic cylinder 210 as shown in FIG. 20. During normal operation of the machine, the cylinder 210 is maintained in its contracted state and acts as a rigid link between the foot pedal, shown at 212, and the motor control, and the foot pedal is operated in conventional manner to effect normal sewing operations, including the conventional synchronising operation discussed above.

The machine incorporates a second synchronising drive which can be activated to cause the motor to set the hook shaft in a predetermined angular position in which the hook will not impede threading of the bobbin thread into the slot 164 of the base 152. This second synchronising drive is actuated in response to movement of the cylinder 210 into its extended state, the body of the cylinder carrying a switch assembly 214 which is actuated by a cam on the piston rod, when the piston rod is extended.

In operation, when the run-out detector device determines that the bobbin is empty, the machine is stopped and the cylinder 210 is expanded to lock down the foot pedal and to actuate the second synchronising drive to place the hook 150 and needle bar in the predetermined angular position preparatory to insertion of the wound bobbin. At the end of the change cycle the cylinder 210 is contracted to release the foot pedal. If the operator retains his foot on the pedal during the bobbin change cycle, the machine will automatically re-start sewing upon release of the cylinder.

System Control

The various pneumatic cylinders in the changing and winding mechanism are controlled by mechanically and/or electrically-actuated valves. Suitable program control means is provided to actuate the valves and other components of the system in the correct sequence to obtain the operations described above. The controls necessary for this will readily be apparent to persons familiar with control systems and it is not necessary for a detailed description to be given here.

Run-out Detector—FIGS. 12 to 19 and 21 to 25

The thread changing and winding mechanism described above incorporates a run-out detector (FIGS. 12 to 19) which provides accurate determination of when the bobbin is empty. This run-out detector may be used independently of the automatic changing and winding mechanism, in order to indicate when the bobbin is empty. In other words, the run-out detector can be used with a lockstitch sewing machine having manual bobbin change in order to indicate to the operator that the bobbin is empty. When the detector senses loss of bobbin thread tension in the manner previously described, the transmitter/receiver 202 will issue a signal to stop the machine and/or to actuate an alarm to warn the operator.

If the detector used in the machine with manual bobbin change is exactly of the form shown in FIGS. 12 to 19, it would usually be necessary for the bobbin also to be of the general form shown, that is with an additional flange equivalent to the flange 25 which is engaged by the bobbin holder. The reason for this additional flange would be to permit the bobbin to be grasped by the fingers of the operator for withdrawal from the stationary base.

Conventionally in a lockstitch sewing machine with manual bobbin change, the bobbin is held in a bobbin case which is held within a stationary base by means of a latch. The case is provided with a latch release which can be grasped in order to withdraw the case, together with the bobbin, from the base. There will now be described a run-out detector, responsive to thread tension, adapted for use with a base which carries a bobbin and bobbin case.

In FIG. 21 there is shown a base 300 which receives a bobbin case 302 housing a bobbin. The bobbin case 302 is substantially of conventional construction, with the addition of an optional thread guide as will be described shortly. More particularly, as shown in FIGS. 22 and 23, the bobbin case 302 is of cup-like form having a spindle 304 in its interior to support the bobbin (not shown). As is conventional, the bobbin case 302 is seated within the base 300 so that the bobbin is enclosed between the case and the base. The base wall 306 of the case 302 carries a latch (not shown) which engages in a groove formed on a spindle of the base 300 and a retractable locating lug 308 which engages into a recess formed on the side wall of the base 300 in order to locate the case 302 relative to the base. The latch and the lug 308 are releasable by means of a tongue 310 pivoted to the outside of the base wall 306 of the case 302; the tongue 310 may be grapsed by the fingers of an operator to release the latch and lug 308 and also to withdraw the bobbin case 302 with bobbin from the base 300. The peripheral wall of the case 302 includes a slot 312 through which the thread passes from the bobbin to the outside of the bobbin case, a leaf spring 314 overlying the slot in order to tension the thread. The thread passes, via the spring 314, between the peripheral walls of the case 302 and base 300 to an outlet slot 316 formed in the base 300. A thread guide loop 318 (FIG. 21) attached to the case 302 may optionally be positioned between the leaf spring 314 and the outlet slot 316, the guide loop 318 preferably being formed by a wire wound spirally in order to facilitate threading of the thread through the loop.

The outlet slot 316 is formed in a peripheral flange of the base 300. The flange is undercut in the zone of the slot 316, as will be seen in FIG. 25. A side edge 320 of the undercut portion is shaped as shown in chain lines in FIG. 24 in order to form a thread guide surface for the bobbin thread when the bobbin thread is under its operating tension. The slot 316 overlies a leaf spring 322 attached to the underside of the undercut portion of the flange adjacent to the other side edge 324 thereof, so that the free end of the spring 322 lies adjacent the side edge 320. The thread passes between the free end portion of the leaf spring 322 and the underside of the flange in order to tension the thread leaving the base. A rigid keeper 326 is provided between the leaf spring 322 in order to limit deflection of the leaf spring.

A thread-engaging member 328 lies within the slot 316 upstream of the leaf spring 322. The thread-engaging member 328 is in the form of a rod extending across the slot, the rod 328 being guided within passages formed in the peripheral flange of the base, for movement in the longitudinal direction of the rod, that is transversely of the slot 316. The part of the rod 328 which lies immediately in the zone of the slot 316 is provided with a flat 330, one edge of the flat being undercut to define a thread-engaging hook 332 which is clearly shown in FIG. 25. The end portion of the rod 328 remote from the hook 332 is offset to form a shutter 334 which moves, upon movement of the rod 328, from a position directly within a hole 336 formed in the peripheral flange of the base (this position being shown in chain lines in FIG. 24) to a position displaced from this hole. A leaf spring 338 biases the rod 328 to the right (as viewed in FIG. 24) to the position in which the shutter 334 lies within the hole 336, the thread-engaging hook 332 in this position lying within the slot, as indicated in FIG. 25.

When a new bobbin is inserted into the base, the thread from the bobbin passes to the outside of the base via the leaf spring 314 on the case 302, the thread guide loop 318, and the thread-engaging hook 332, the thread then passing between the leaf spring 322 and the underside of the peripheral flange. At the start of sewing, the bobbin thread is pulled by the initial loops of the needle thread onto the path shown at 340 in chain lines in FIGS. 21 and 24 where the thread passes along the guide surface 320. This movement is progressive as the bobbin thread tension builds up during the initial few stitches and the movement also causes the rod 328 to be moved to the left (as viewed in FIG. 24) against the bias of the leaf spring 338, thus displacing the shutter 334 from within the hole 336. When the bobbin thread tension falls, just as the bobbin thread is about to become fully depleted, the shutter 334 is returned by the bias of spring 338 to its original position within the hole 336. The movement of the shutter 324 is sensed by a transmitter/receiver device (similar to the device 202) which is positioned facing the base 300 to direct a light beam (or other energy beam) into the hole 336. The bottom of the hole is made reflective by means of an appropriate coating so that when the shutter 334 is displaced under the tension of the bobbin thread, the reflective surface is exposed and light will be reflected back to the receiver part of the transmitter/receiver device by the exposed reflective surface. When the shutter 334 returns to its original position within the hole upon loss of bobbin thread tension, the reflective surface will be covered and the receiver part will respond to the absence of reflected light by issuing a signal which actuates an alarm and/or stops the machine, in order to indicate depletion of the bobbin thread. Instead of forming the reflective surface on the bottom of the hole, the reflective surface may be formed on the shutter itself, the receiver part then being made responsive to receipt of reflected light consequent on return of the shutter to its original position upon loss of bobbin thread tension. Instead of using a light beam, other forms of reflectable energy beams, for example a sonic beam, may be used.

In order to prevent false actuation of the detector during the build-up of bobbin thread tension at the start of sewing with a fresh bobbin, the control circuitry may incorporate inhibit means which inhibits activation of the alarm or stop switch for a predetermined number of stitches, for example six stitches. This may be effected as described earlier in connection with the automatic change mechanism.

In a slightly modified arrangement (not shown), the leaf spring on the bobbin case may be replaced by a leaf spring on the inner peripheral surface of the base. In this modification, the leaf spring is hook shaped and substantially corresponds in position to the thread-engaging hook 168 as shown in FIG. 16. The base, which is otherwise of the form shown in FIGS. 21, 24 and 25, can be used with manual bobbin change in the manner described, but also permits an automatic bobbin change and winding mechanism (of the type described in connection with FIGS. 1 to 20) to be added subsequently, without having to replace the base.

The embodiments have been described by way of example only and modifications are possible within the scope of the invention which includes every novel feature or novel combination of features herein disclosed.

I claim:

1. A lockstitch sewing machine having a bobbin and a stationary base, said bobbin being mounted within the base, said base including a peripheral wall which surrounds the bobbin, and means for defining a thread guide path from the bobbin and a run-out detector for sensing when the bobbin is empty, said detector comprising hook means carried by the base and engaged with the thread extending from the bobbin along said thread guide path such that the hook means is displaced from a first position by the bobbin thread when under tension;

bias means for returning the hook means to its first position as a result of loss in thread tension;

means for transmitting an energy beam;

means for receiving the energy beam; and means for influencing the energy beam, said influencing means being linked to the hook means and movable relative to the path of said energy beam upon movement of the hook means to its first position consequent on loss of thread tension, said beam receiving means being responsive to such influence of the beam to provide a signal indicative of a run-out condition.

2. A sewing machine according to claim 1, wherein the energy beam transmitting means is operative to direct the mean onto a reflective surface for reflection back to the receiving means, and the means for influencing said beam is movable to effect selective exposure or non-exposure of the reflective surface to the beam directed from said transmitting means.

3. A sewing machine according to claim 2, wherein the means for influencing the beam comprises a shutter movable by said hook means to expose or block the reflective surface relative to the beam directed from said transmitting means.

4. A sewing machine according to claim 1, wherein the energy beam transmitting means is operative to direct the beam onto a reflective surface for reflection back to the receiving means, said reflective surface being movable by said hook means and forming said means for influencing the beam.

5. A sewing machine according to claim 1, wherein the energy beam transmitting means is operative to transmit the beam through a hollow core of the bobbin onto a reflective surface on the hook of the machine to be reflected back through the bobbin core to the receiving means, and the means for influencing said beam comprises a shutter movable to expose or block the reflective surface.

6. A sewing machine according to claim 1, wherein the hook means is mounted in the base for pivotal movement about the axis of the bobbin, the hook means being so positioned that thread from a wound bobbin inserted into the base is pulled by the needle thread at the start of sewing to be looped around said hook member.

7. A sewing machine according to claim 1, further comprising inhibit means for inhibiting operation of the detector for a predetermined number of stitches after the start of sewing with a wound bobbin to permit build-up of bobbin thread tension to its normal operating tension.

8. A sewing machine according to claim 1, further comprising a mechanism for changing an empty bobbin, said mechanism comprising a bobbin change device for removing the empty bobbin from the base of the machine and for inserting a previously-wound bobbin into the base, said signal produced by said beam receiving means initiating operation of the bobbin change device.

9. A sewing machine according to claim 8, wherein the energy beam transmitting means is operative to transmit the beam through a hollow core of the bobbin onto a reflective surface on a hook in which the base is mounted to be reflected back through the bobbin core to the receiving means, and the means for influencing the beam comprises a shutter movable to expose or block the reflective surface.

10. A sewing machine according to claim 8, wherein the hook means is mounted in the base for pivotal movement about the axis of the bobbin, the hook means being so positioned that thread from the wound bobbin inserted into the base is pulled by the needle thread at the start of sewing to be looped around said hook member.

11. A sewing machine according to claim 10, further comprising inhibit means for inhibiting operation of the change device for a predetermined number of stitches after the start of sewing whereby to permit build-up of bobbin thread tension to its normal operating tension.

12. A sewing machine according to claim 1, further comprising means responsive to the run-out detector for withdrawing the empty bobbin from the base and for subsequently inserting a previously-wound bobbin into the base to enable the machine to resume sewing, and means for rewinding the empty bobbin during operation of the sewing machine, the latter bobbin, when rewound, being in condition to be inserted onto the hook in a subsequent bobbin-change cycle.

13. A sewing machine according to claim 12, wherein the bobbin withdrawal and inserting means comprises a turret rotatable about an axis of rotation, said turret carrying a plurality of bobbin holders angularly spaced about said axis, each said bobbin holder having means actuable to releasably hold a bobbin, means for angularly indexing the turret to place the respective bobbin holders in successive angular alignment with a hook housing the base and with a bobbin winding position, and means for displacing the turret axially towards and away from said hook such that a said bobbin in angular alignment with the hook is able to present a freshly wound bobbin to said base upon movement of the turret axially towards the hook and to withdraw an empty bobbin from the hook upon movement of the turret axially away from the hook.

14. A sewing machine according to claim 13, wherein the hook includes a reflective surface in a position aligned with a hollow core of the bobbin mounted in the base, and the beam transmitting means is operative to direct the beam through the hollow core of the bobbin onto the reflective surface to be reflected back through the hollow core for receipt by the receiving means, and the means for influencing the beam comprises a shutter movable to expose or block the reflective surface, said receiving means being responsive to the presence or absence of the reflected beam.

15. A sewing machine according to claim 13, wherein the bobbin winding means comprises means for rotating the bobbin holder at the bobbin winding position whereby to cause a winding rotation of an empty bobbin held by that bobbin holder.

16. A sewing machine according to claim 15, wherein the turret comprises a respective thread holder associated with each said bobbin holder, each said thread holder including friction holding means for frictionally holding the thread, said mechanism further comprising a thread guide system for guiding thread from a thread source via an empty bobbin at the winding position, to the thread holder means associated with the bobbin holder aligned with the hook.

17. A sewing machine according to claim 16, wherein the friction holding means associated with the bobbin holder aligned with the hook is, after angular indexing movement of that bobbin holder from the bobbin winding position, operative to hold the thread at two spaced holding positions between a freshly-wound bobbin held by that bobbin holder and the thread source, said mechanism further comprising means for cutting the thread in the zone between the two spaced holding positions such that a cut end portion of the thread leading to the freshly-wound bobbin is held at a first of said positions, and the cut end portion of the thread leading to the thread source via the empty bobbin is held at a second of said positions.

18. A sewing machine according to claim 13, wherein the hook means is mounted in the base for pivotal movement about the axis of the wound bobbin inserted into the base, the hook means being so positioned that the thread portion extending between a freshly wound bobbin inserted into the base and the said first holding position is pulled from said first holding position by the needle thread at the start of sewing, to be looped around the hook means.

19. A mechanism according to claim 17, wherein the bobbin winding means further comprises means for picking up the cut end portion of the thread held at said second holding position and for winding said end portion around a groove in the bobbin core of the empty bobbin whereby to prevent thread slippage during winding of the thread from the source.

20. A mechanism according to claim 19, wherein the means for picking up the cut end portion of the thread comprises a wheel rotatable about an axis aligned with the axis of the bobbin holder at the bobbin winding position, the wheel having a rim with a thread-engaging hook axially alignable with the groove in the bobbin core, and means for driving said wheel such that the thread-engaging hook engages the portion of the thread extending between the empty bobbin and the second holding position whereby to wind said portion around the groove.

* * * * *

UNITED STATES PATENT AND TRADEMARK OFFICE

CERTIFICATE OF CORRECTION

PATENT NO. : 4,681,050

DATED : July 21, 1987

INVENTOR(S) : Nikolaos Kosmas

It is certified that error appears in the above-identified patent and that said Letters Patent are hereby corrected as shown below:

In Column 3, line 18, insert a space between "8b" and "of."

In Col. 16, line 8, "mean" should read --beam--.

In Col. 17, line 10, between "in" and "condition" insert --a--.

In Col. 17, line 10, "onto" should read --into--.

In Col. 17, line 22, between "bobbin" and "in" insert --holder--.

Signed and Sealed this

Fifth Day of April, 1988

*Attest:*

*Attesting Officer*

DONALD J. QUIGG

*Commissioner of Patents and Trademarks*